US006793368B2

(12) United States Patent
Ladstätter

(10) Patent No.: US 6,793,368 B2
(45) Date of Patent: Sep. 21, 2004

(54) LUMINAIRE HAVING A PLURALITY OF POT REFLECTORS

(75) Inventor: Gerald Ladstätter, Klaus (AT)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 10/465,227

(22) Filed: Jun. 20, 2003

(65) Prior Publication Data

US 2004/0042203 A1 Mar. 4, 2004

Related U.S. Application Data

(63) Continuation of application No. PCT/EP02/11102, filed on Oct. 2, 2002.

(30) Foreign Application Priority Data

Oct. 22, 2001 (DE) ..... 101 51 958

(51) Int. Cl.[7] ..... F21V 7/06

(52) U.S. Cl. ..... 362/217; 362/297; 362/346; 362/350

(58) Field of Search ..... 362/217, 260, 362/297, 346, 304, 350

(56) References Cited

U.S. PATENT DOCUMENTS 5,884,994 A 3/1999 Herst et al. ..... 362/256
6,210,018 B1 * 4/2001 Kassay et al. ..... 362/216
6,247,828 B1 6/2001 Herst ..... 362/217
6,641,282 B2 * 11/2003 Perlo et al. ..... 362/217

FOREIGN PATENT DOCUMENTS

| | | |
|---|---|---|
| EP | 0359069 A2 | 9/1990 |
| WO | WO 93/12376 | 6/1993 |
| WO | WO 01/36868 A1 | 5/2001 |

* cited by examiner

*Primary Examiner*—John Anthony Ward
(74) *Attorney, Agent, or Firm*—Fitzpatrick, Cella, Harper & Scinto

(57) ABSTRACT

A luminaire (1) has means for holding and for electrically connecting a tube-like lamp (2) and a back reflector (4), extending over the length of the lamp (2), which is provided for the purpose of reflecting a part of the light emitted from the lamp (1) counter to a certain emission direction. In the back reflector there are provided through-openings (5) which are provided for the purpose of allowing a part of the light emitted from the lamp (2) to pass through in the emission direction, whereby pot reflectors (6) adjoin onto the through-openings (5) in the back reflector (4) in the emission direction. The luminaire distinguishes itself through the variety of the illumination effects which can be achieved therewith, which however have no effect on the functionality of the luminaire for room illumination or for the illumination of workplaces.

22 Claims, 6 Drawing Sheets

LUMINAIRE HAVING A PLURALITY OF POT REFLECTORS

CROSS REFERENCE TO RELATED APPLICATIONS

This is a Continuation of International Application PCT/EP02/11102 filed Oct. 2, 2002 which in turn claims priority of German Application No. 101 51 958.3 filed Oct. 22, 2001, the priorities of which are hereby claimed, said International Application having been published in German, but not in English, as WO 03/036161 on May 1, 2003. The disclosure of that International Application PCT/EP02/11102 is hereby incorporated by reference in its entirety, as if fully set forth herein.

BACKGROUND OF THE INVENTION

1. Field of the Invention

The present invention relates to a luminaire with which interesting and appealing illumination effects can be attained, despite these effects the luminaire ensuring an optimal room illumination for work purposes.

2. Description of the Related Art

In offices or at other workplaces there are usually employed for illumination luminaires having elongate, rod-shaped light sources, for example fluorescent tubes. In order to obtain an illumination of the room which is suitable for work purposes and thereby in particular to avoid dazzling effects, there are arranged before the luminaire, in the emission direction, lamella rasters, or other means of influencing the light, with which the exit of light is restricted to a predetermined region. The employment of fluorescent lamps thereby ensures a high light yield with a relatively slight energy requirement.

Beyond this, in some cases, halogen spotlights also find employment, which consist of a low voltage halogen lamp which is surrounded by a small pot-shaped reflector. This reflector has a diameter of only a few centimetres and lends the spotlight an elegant appearance. However, in order to attain a sufficient overall brightness, the employment of many individual such halogen spotlights would be necessary.

SUMMARY OF THE INVENTION

It is the object of the present invention to provide a new type of luminaire which distinguishes itself through an elegant and appealing appearance and at the same time ensures an optimal room illumination.

This object is achieved by means of a luminaire that is constructed in accordance with the invention. The luminaire comprises, first, means for holding and electrically connecting a tube-like lamp and a back reflector, extending over the length of the lamp, which serves the purpose of reflecting a part of the light emitted from the lamp counter to a particular emission direction. Beyond this there are provided in the back reflector through-openings which serve the purpose of allowing a part of the light emitted from the lamp to pass through in the emission direction, pot reflectors adjoining onto the through-openings of the back reflector in the direction of emission.

The basic concept of the present invention thus consists in emitting the light of an individual tube-like lamp via a plurality of pot-shaped reflectors. This has on the one hand the advantage that the impression of a row arrangement of individual halogen spotlights is attained, on the other hand there can be achieved, as will be described in detail below, a multiplicity of appealing lighting effects. Beyond this, the luminaire in accordance with the invention distinguishes itself through its simple construction, since the reflector arrangement consisting of the back reflector and the pot reflectors can be formed in one piece, which can be achieved for example in that the reflector arrangement is produced in an injection molding process.

An advantageous further development of the luminaire in accordance with the invention consists in that the pot reflectors are connected with one another in their edge regions via a connection plate arranged parallel to the lamp whereby the connection plate may likewise be connected in one piece with the pot reflectors or the overall reflector arrangement. A particularly appealing optical effect can then be attained in that the connection plate itself is transparent. Namely, if a part of the light emitted from the tube-like lamp is deflected into a region outside the pot reflectors the structure can be perceived through the transparent connection plate. The bringing of light into the region outside the pot reflectors can be achieved for example in that the back reflector is at least partly light permeable. Further, there arises thereby the possibility to color the back reflector in its transparent regions, so that the connection plate appears in a altered color tone. The pot reflectors may thereby project with their light exit openings beyond the connection plate or end flush with the connection plate.

The back reflector is preferably so configured that it at least partially encompasses the lamp, in particular it may be formed to be semicircular in cross-section.

A further advantage of the luminaire in accordance with the invention consists in that a part of the light given out by the lamp is employed for indirect illumination. In particular it can be provided that a screening or filter plate is provided at the side of the lamp opposite to the pot reflectors, via which a part of the light emitted by the lamp is directed towards the ceiling of the room to be illuminated. The edge regions of this screening or filter plate may, in contrast, be formed to be reflecting, in order to make possible a deflection of a part of the light into the room surrounding the pot reflectors. Here also there exists the possibility of providing that the light permeable region of the screening or filter plate is colored, and therewith to allow the ceiling region above the lamp to appear in a different color tone.

The present invention also relates to an intermediate product for the manufacture of a luminaire, which is a one-piece injection molded part which has an elongate back reflector part which is so formed that it partly encloses an elongate hollow space, and through-openings in the back reflector part and pot reflector parts which surround the through-openings on the side of the back reflector away from the hollow space. This intermediate product forms the basic element for the above-described reflector arrangement and distinguishes itself in that it can be manufactured in a single process step by means of injection molding and thus very simply. Thereby, in the case of more complex structures, the injection molded part is demolded by means of the so-called core slide technique in which mold parts additional to the molding tool can be removed upwardly or downwardly, or to the side outwardly, that is in simple, straight-line movements. In the ideal case the injection molded part can be manufactured even with a core slide-less and thus particularly economical molding tool.

BRIEF DESCRIPTION OF THE DRAWINGS

Below, the present invention will be described in more detail with reference to the accompanying drawings.

DETAILED DESCRIPTION OF THE PREFERRED EMBODIMENTS

Figure 1:
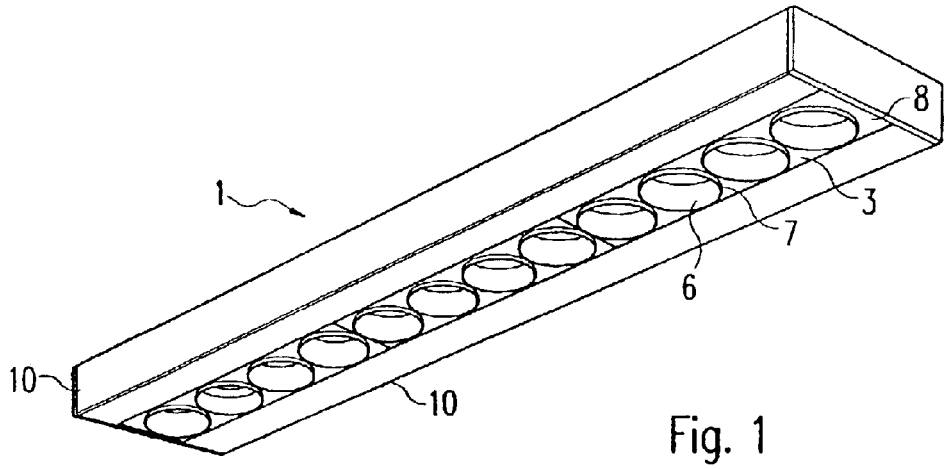
FIG. 1 depicts a first exemplary embodiment of a luminaire in accordance with the invention, in a perspective view.
Figure 2:
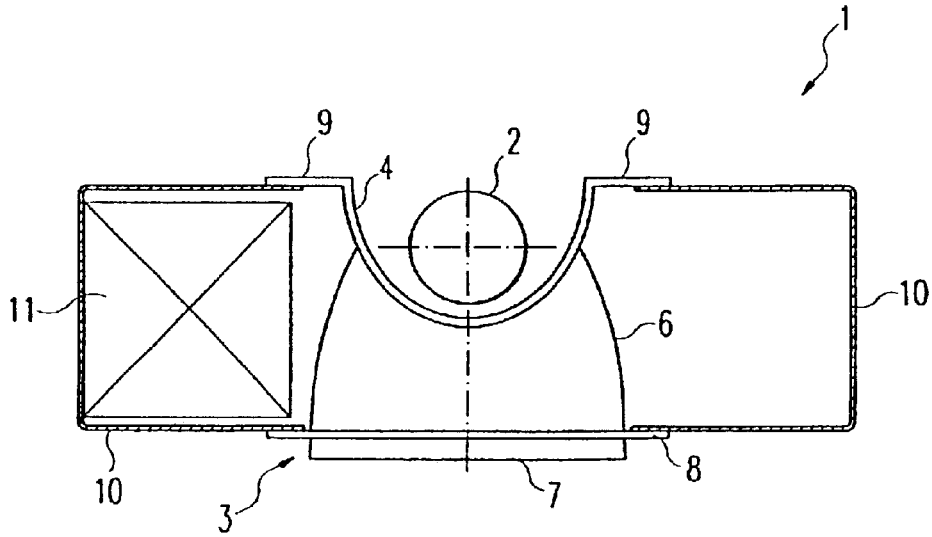
FIG. 2 depicts the luminaire illustrated in FIG. 1, in section.

The luminaire 1, shown in FIG. 1 in a perspective illustration and in FIG. 2 in section, comprises in substance a tube-like elongate lamp 2, which may preferably be a fluorescent lamp, and a reflector arrangement 3 arranged to the side or before the lamp 2 in the emission direction. The reflector arrangement 3 is formed by means of a back reflector 4 semicircular in section, extending over the length of the lamp 2, from which there extend in the direction of emission a plurality of pot reflectors 6 having a circular light exit opening 7. The lamp 2 is thereby arranged within the semicircular longitudinal reflector 4.

The pot reflectors 6 adjoin to through-openings of the back reflector 4, so that a part of the light emitted from the lamp 2 is directed downwardly via these through-openings and the pot reflectors 6. The pot reflectors 6 thus serve for the direct illumination of the space lying below the lamp 1 and have a shape through which the light emitted downwardly from the lamp 2 is restricted to a predetermined exit angle. Since in this manner dazzle effects are avoided, the luminaire 1 in accordance with the invention can be put to use in particular also for room illumination at office work stations.

To both sides of the reflector arrangement 3 there are located side boxes 10 which extend over the length of the lamp 2 of which one serves for holding an operating apparatus 11 for the lamp 2. This operating apparatus 11 may be in particular an electronic ballast for the operation of a gas discharge lamp, in particular a fluorescent tube; illustration of the fittings for holding and electrically connecting the lamp 2 is omitted in order to provide an overview.

The attachment of the two side boxes 10 to the reflector arrangement 3 is effected with the aid of side webs 9 which project from the outer sides of the back reflector 4, and a connection plate 8 arranged parallel to these side webs 9. This connection plate 8 connects the pot reflectors 6 at their edge regions, whereby the pot reflectors, with their light exit openings 7, project slightly with respect to the connection plate 8. The connection plate 8 and the side webs 9 serve further for the generation of particular lighting effects, as will be explained below.

Along with the direct illumination achieved via the pot reflectors 6, a part of the light given out by the lamp 2 is also directed upwardly via the back reflector 4 and correspondingly serves for indirect room illumination. Thereby the possibility arises of varying the relationship between the direct illumination via the pot reflectors 6 and the indirect illumination via the back reflector 4 by means of an alteration of the lamp position with regard to the back reflector 4. Through this, the lighting properties of the luminaire 1 can be adapted to external conditions.

Figure 3:
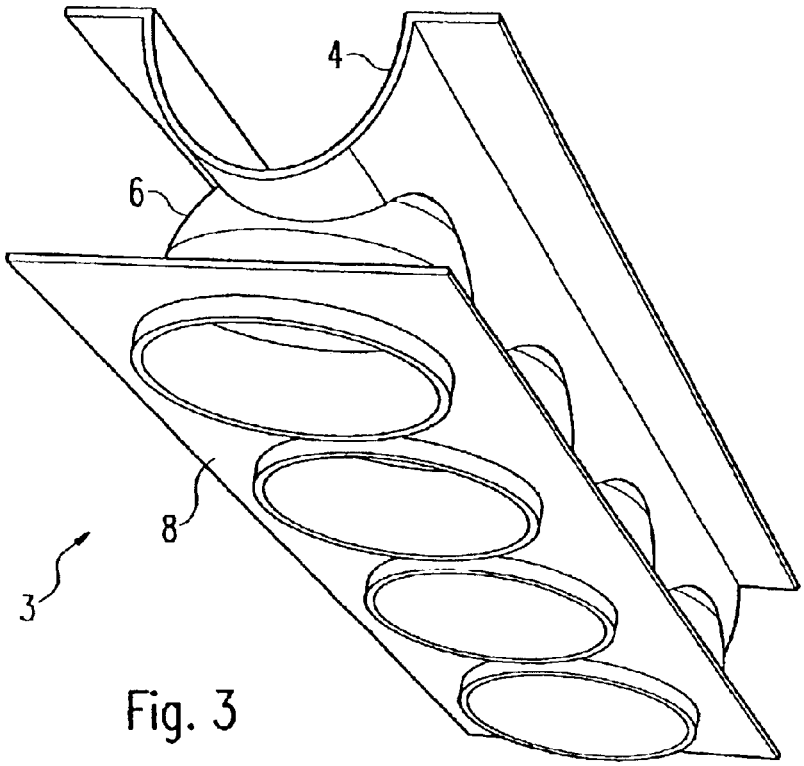
FIG. 3 depicts the reflector arrangement of the luminaire illustrated in FIGS. 1 and 2, in a perspective view.

The reflector arrangement 3 with the back reflector 4 and the pot reflectors 6 is preferably formed by a single part, which is produced for example by means of injection molding. Thereby, in the ideal case, the reflector arrangement 3 can be manufactured with a simply constituted, core slide-less molding tool; in the case of more complex structures the tool is demolded by means of the above-mentioned core slide technique. The connection plate 8 is also a part of this one-piece plastics part, which is illustrated in FIGS. 3 and 4 to an enlarged scale.

Figure 4:
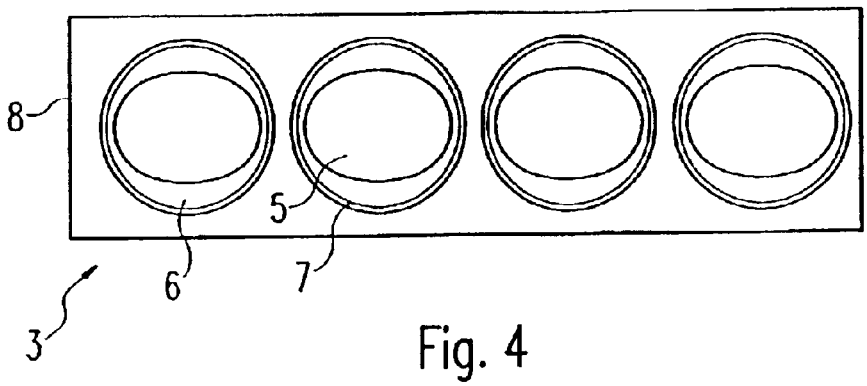
FIG. 4 depicts the underside of the reflector arrangement.

As can be appreciated in particular from the illustration in FIG. 4, the underside of the back reflector 4 has a plurality of through-openings 5 to which there adjoin the pot reflectors 6 which in turn are connected with one another in their end regions via the ca. 1–2 mm thick connection plate 8. The pot reflectors 6, provided at least on their inner sides with a reflection coating, preferably have a size corresponding to conventional halogen spotlights, of ca. 40–60 mm in diameter.

In order to strengthen the impression that a row arrangement of individual halogen spotlights is involved, it can be provided that the inside of the pot reflectors 6 is configured in a facet-like manner. The production of the individual facets is already effected in the manufacture of the plastics part during the injection molding and is achieved by means of a corresponding configuration of the molding tool. The application of the reflection coating is preferably effected through vapor deposition of an aluminium coating in high vacuum. In this way reflector arrangements of various lengths can be manufactured. Alternatively to this there is, however, also the possibility, illustrated in FIG. 1, of forming an overall reflector by means of a plurality of similar individual modules, which are joined to one another. The advantage of this solution consists in that solely a single molding tool is necessary for the production of the reflector arrangement, through which the manufacturing costs are significantly reduced.

Particular lighting effects can be generated with the luminaire 1 in accordance with the invention in that the various regions of the reflector arrangement 3 are formed to be differently reflecting or differently light permeable. This will be explained below with reference to FIGS. 5 and 6, which show two variants of the luminaire 1 illustrated in FIG. 1.

Figure 5:
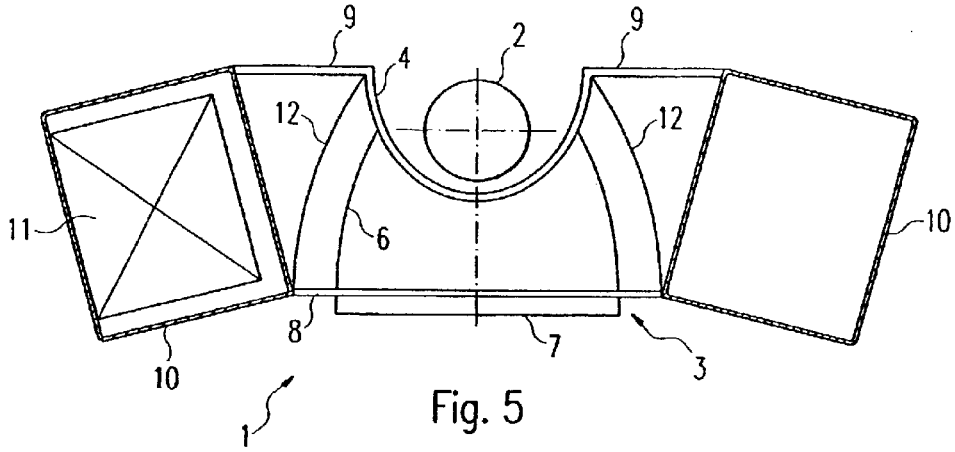
FIG. 5 is a first variant of the luminaire in accordance with the invention.

With respect to the luminaire illustrated in FIG. 1, the variant illustrated in FIG. 5 differs through the inclined arrangement of the two side boxes 10, through which the luminaire 1 is lent overall an altered character. In order, beyond this, to strengthen in the impression that a row arrangement of individual halogen spotlights is present, the outer sides of the pot reflectors 6 are brightened so that their pot shape can be perceived through the transparent connection plate 8. This brightening of the outer sides of the pot reflectors 6 is achieved in that the back reflector 4 is formed to be partially light permeable at least in its upper regions, so that a part of the light given out by the lamp 2 can pass through the back reflector 4. This light thus falls into a light chamber which is bounded by the side wall of the back reflector 4, the pot reflectors 6, the connection plate 8 and additional reflectors 12 to the two sides of the pot reflectors 6. The light entering into the light chamber can again leave it via the connection plate 8, so that the outer side of the pot reflectors 6 is perceivable. A further advantage of this configuration consists in that the luminaire 1, when observed in a flat angle range, does not appear to be dark but presents itself rather as a luminous but dazzle-free body.

Figure 6:
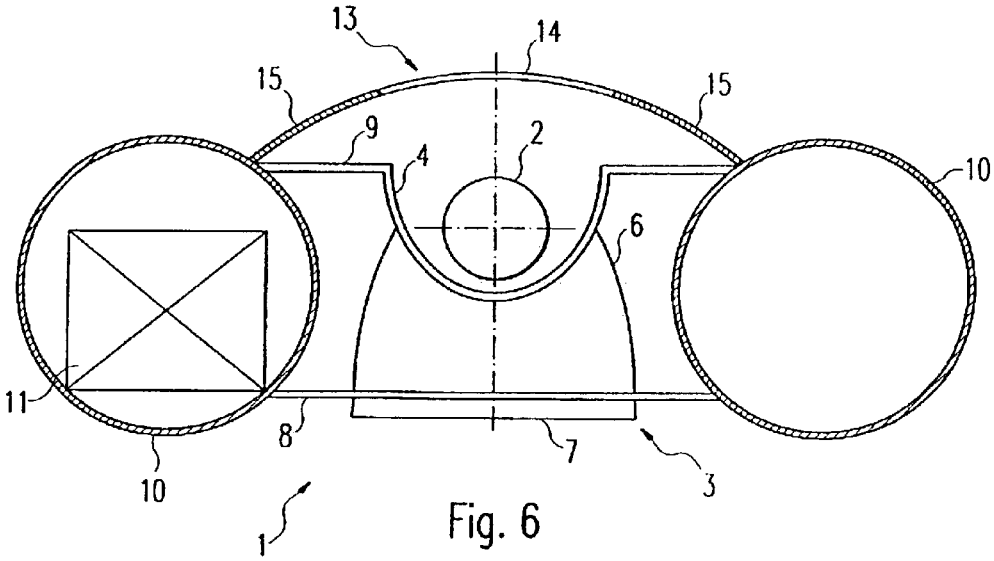
FIG. 6 is a second variant of the luminaire in accordance with the invention.

The above-described effect of the brightening of the outer sides of the pot reflectors 6 is also attained in the variant illustrated in FIG. 6, in which there are provided side boxes 10 which are circular in section. For this purpose there is provided at the upper side of the luminaire 1 a screening or filter plate 13 curved in section, extending over the lengths of the lamp 2, which is light permeable in its middle region 14, so that a part of the light given out by the lamp 2 is emitted upwardly and can be employed for ceiling illumination. In its end regions 15, in contrast, the screening or filter plate 3 is formed to be diffusely reflecting, for example coated white, so that the light from the lamp 2 incident on these regions 15 is reflected downwardly. Furthermore, with this variant the two side webs 9 are formed to be light permeable, so that light reflected at the side regions 15 of the screening or filter plate 13 can enter via the side webs 9 into the region between the side boxes 10 and the pot reflectors 6, illuminate the outer side of the pot reflectors 6 and then leave this region via the transparent connection plate 8. With this variant the back reflector 4 can thus also be constituted to be fully reflecting.

A further development of the variant illustrated in FIG. 6 can consist in constituting the side webs 9 as color filters, so that the light brightening the outer side of the pot reflectors 6 is colored. Through this additional color effects can be attained which, however, do not influence the light emitted via the pot reflectors downwardly and employed for the actual room illumination. The configuration as color filter can of course also be provided with the variant illustrated in FIG. 5. The screening or filter plate 13 illustrated in FIG. 6 can be also be put to use with other variants of the luminaire 1 in accordance with the invention and for example can likewise be constituted as a color filter, in order to allow the ceiling region surrounding the luminaire to appear in a different color tone. Further, color filters, reflection surfaces or partial coverings can be combined in any desired manner, in order to obtain various illumination effects.

Figure 7:
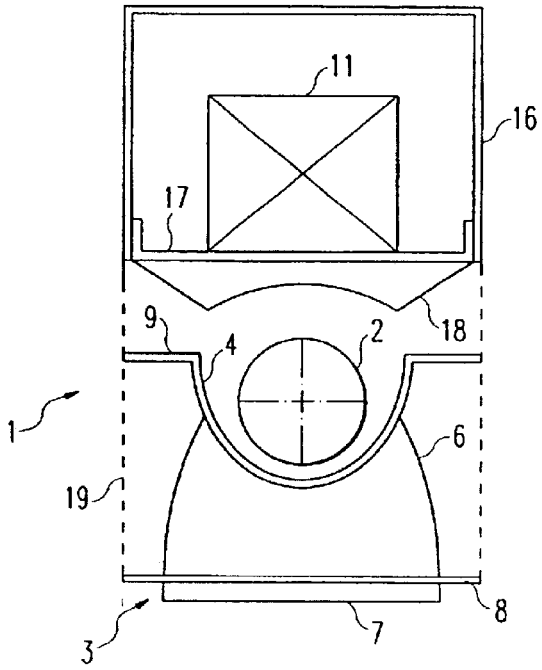
FIG. 7 is a third variant of the luminaire in accordance with the invention, which is intended for attachment to a carrier rail.

The luminaire in accordance with the invention can also be provided on a carrier rail 16 as is the case with the variant illustrated in FIG. 7. The U-shaped carrier rail 16 thereby serves also for receiving the operating apparatus 11 for the lamp 2. The attachment of the lamp 1 to the carrier rail 16 is effected by means of a cover cap 17 which can be put in place from the underside into the carrier rail 16 and coupled therewith mechanically, for example latched. On the underside of the mounting cap 17 there is located further a roof reflector 18 which in the mounted condition of the luminaire 1 is arranged above the lamp 2. This roof reflector 18 is so configured that light emitted from the lamp 2 to the side upwardly brightens the ceiling regions surrounding the carrier rails 16. The attachment of the reflector 3 to carrier rail 16 or the closure cap 17 is effected with the aid of end parts 19 which hold together the various components of the luminaire 1.

Figure 8:
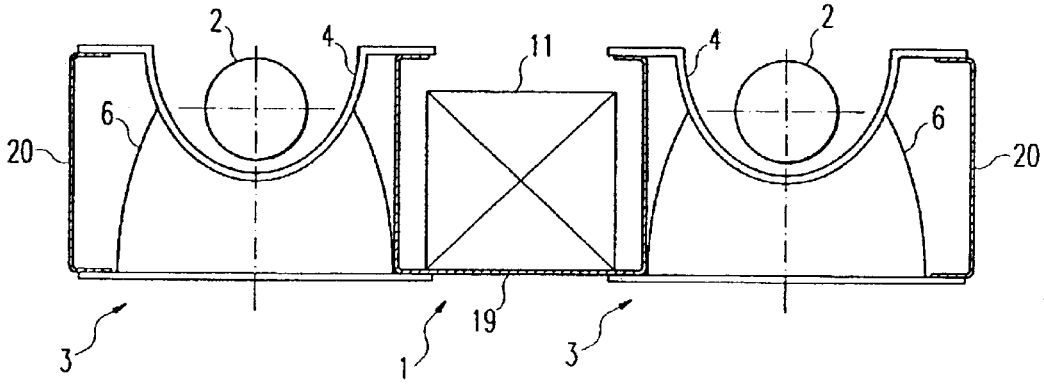
FIG. 8 is a fourth variant of the luminaire in accordance with the invention, having two tube-like lamps.

FIG. 8 shows a double-lamp variant of the luminaire 1 in accordance with the invention, with which two fluorescent lamps 2 and reflector arrangements 3 associated with the lamps are arranged to the two sides of a box 19. The ballasts 11 for the operation of the lamps 2 are both arranged in the box 19; on the sides away from the box the reflector arrangements 3 are closed off by C-shaped side walls 20.

Figure 9:
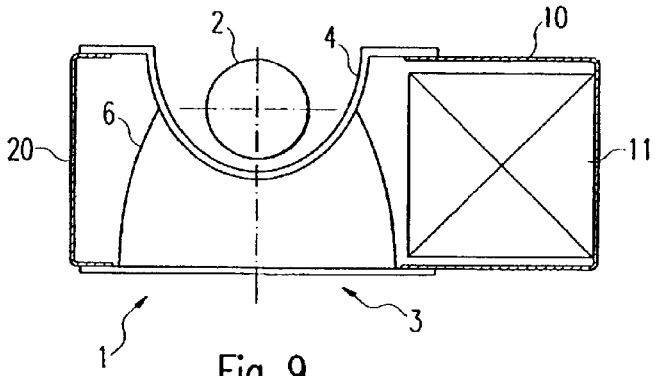
FIG. 9 is a further exemplary embodiment of a luminaire in accordance with the invention.

FIG. 9 shows an asymmetric variant of the luminaire 1 in accordance with the invention, with which a further side box 10 which was provided in the case of the exemplary embodiments of FIGS. 1, 5 and 6 for reasons of symmetry is omitted. Instead, a C-shaped side wall again closes off the reflector arrangement 3 at the side opposite to the box 10.

Figure 10A:
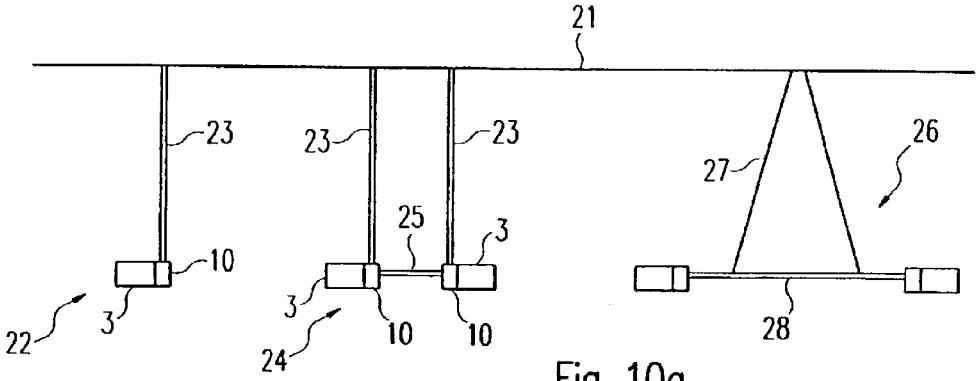
FIGS. 10*a* and 10*b* depict various application possibilities for the luminaire illustrated in FIG. 9.
Figure 10B:
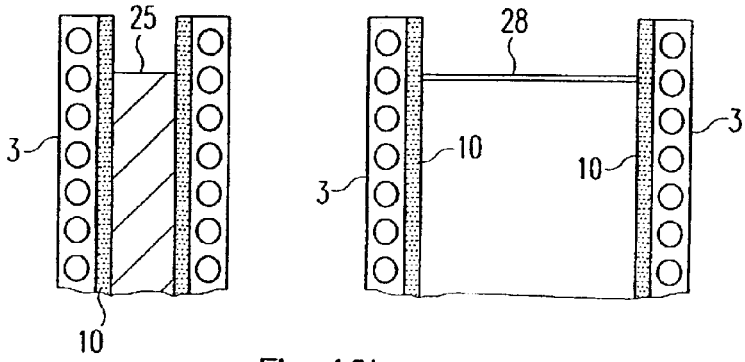

The luminaire can, in its asymmetric shape, be attached alone to a ceiling 21 of a room with the aid of a attachment rod 23 or cables, as is illustrated in FIG. 10*a* on the left side. Beyond this, however, there is also the possibility of combining two such asymmetric luminaires 1, in order to again attain a symmetric overall arrangement 23 or 26. This can be effected for example in that between the two asymmetric luminaires, which are again each attached to the ceiling with the aid of attachment rods 23, there is arranged a decorative surface 25 which for example is transparent or has a grid structure. In the variant 26 illustrated in the right side of FIG. 10*a* the two asymmetric luminaires are, in contrast, connected with one another via connecting tube 28, whereby the overall arrangement is attached to the ceiling 21 with the aid of steel cables 27. FIG. 10*b* shows the undersides of these two variants.

Figure 11:
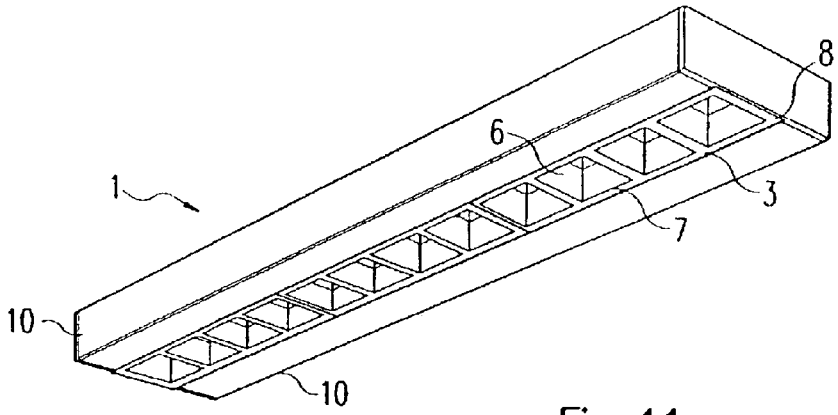
FIG. 11 is a further exemplary embodiment of a luminaire in accordance with the invention having quadratic pot reflectors.
Figure 12:
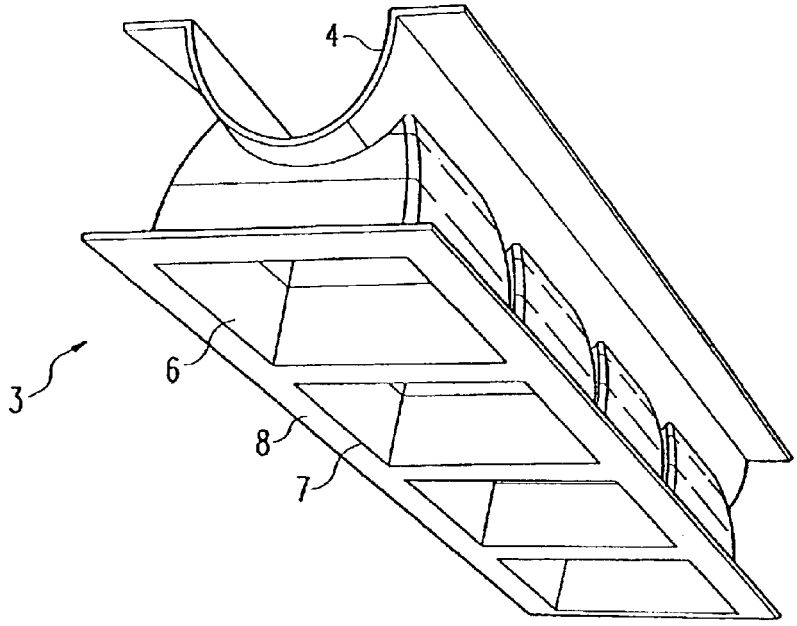
FIG. 12 depicts the reflector element of the luminaire illustrated in FIG. 11.

The shape of the pot lights can in principle be selected as desired. In the case of the exemplary embodiment of the luminaire 1 in accordance with the invention illustrated in FIG. 11, the reflector arrangement 3 of which is shown in an enlarged illustration in FIG. 12, the pot reflectors 6 are provided with a quadratic light exit opening 7. Further, with this embodiment, it is avoided that the edge regions of the pot lights 6 project beyond the connection plate 8. However, other shapes will also be conceivable for the pot reflectors 6, for example they may be oval or rectangular.

The reflectivity of the individual regions of the reflector arrangement 3 can be individually configured. Thus, for example, the pot reflectors 6 may be configured to be very smooth at their inner side, so that by vapor deposition a highly polished layer arises, whilst in contrast the connection plate 8 surrounding the pot reflector 6 may be somewhat more coarsely structured, so that a matt coating is provided. This can be taken into account already in the configuration of the injection molding tool, so that no finishing of the plastics workpiece is necessary.

The luminaire in accordance with the invention thus distinguishes itself through the variety of the illumination effects which can be achieved thereby, which however have no effect on the functionality of the luminaire for room illumination or for illumination of workplaces.

What is claimed is:

1. A luminaire comprising:

a) means for holding and electrically connecting at least one tube-like lamp;

b) a back reflector extending over a length of the lamp, provided for the purpose of reflecting a part of light emitted by the lamp in a direction opposite from a particular emission direction;

c) through-openings in the back reflector which are provided for the purpose of allowing a part of the light emitted by the lamp to pass through in the particular emission direction; and d) pot reflectors which in the particular emission direction adjoin the through-openings in the back reflector.

2. A luminaire according to claim 1, wherein the back reflector and the pot reflectors are connected with one another in one piece.

3. A luminaire according to claim 1, wherein the pot reflectors are connected with one another at their edge regions via a connection plate arranged parallel to the lamp.

4. A luminaire according to claim 3, wherein the connection plate is connected in one piece with the pot reflectors.

5. A luminaire according to claim 3, wherein the connection plate is transparent.

6. A luminaire according to claim 3, wherein the connection plate is about 1–2 mm thick.

7. A luminaire according to claim 3, wherein the pot reflectors with their light exit openings project beyond the connection plate.

8. A luminaire according to claim 1, wherein the back reflector at least partially encompasses the lamp.

9. A luminaire according to claim 8, wherein in cross-section the back reflector is semicircular.

10. A luminaire according to claim 1, wherein the back reflector is at least partially transparent.

11. A luminaire according to claim 10, wherein the back reflector is colored in its transparent regions.

12. A luminaire according to claim 1, wherein there is arranged at a side of the lamp opposite to the pot reflectors a screening or filter plate which is formed to be reflecting in its edge regions.

13. A luminaire according to claim 1, wherein the back reflector together with the pot reflectors is arranged between two side boxes of which one contains an operating apparatus for operation of the lamp.

14. A luminaire according to claim 1, wherein the at least one tube-like lamp includes two tube-like lamps which are arranged to a side of a box containing an operating apparatus for the lamps and with each of which lamps there is associated a back reflector with pot reflectors.

15. A luminaire according to claim 1, wherein the reflector arrangement, formed of the back reflector and the pot reflectors, is formed by means of an injection molded part.

16. A luminaire according to claim 1, wherein inner sides of the pot reflectors are facetted.

17. A luminaire according to claim 1, wherein the pot reflectors have a circular light exit opening.

18. A luminaire according to claim 1, wherein the pot reflectors have a quadratic or rectangular light exit opening.

19. A luminaire according to claim 1, wherein light exit surfaces of the pot reflectors have a size of about 40–60 in diameter.

20. An intermediate product for the manufacture of a luminaire, comprising a one-piece injection molded part comprising (a) an elongate back reflector part which is so shaped that it partially encloses an elongate hollow chamber, the back reflector arranged to reflect light in a direction opposite from a particular direction, (b) through-openings in the back reflector part, the through-openings arranged to allow light to pass through in the particular direction, and (c) pot reflector parts which surround the through-openings at a side of the back reflector part away from the hollow chamber.

21. An intermediate product according to claim 20, wherein the pot reflector parts are connected with one another in their edge regions via a connection plate running parallel to the back reflector part.

22. An intermediate product according to claim 20, wherein in cross-section the back reflector part is semicircular.

* * * * *